US011330685B2

(12) United States Patent
Chen et al.

(10) Patent No.: US 11,330,685 B2
(45) Date of Patent: May 10, 2022

(54) METHOD, DEVICE, TERMINAL SETTING AND READABLE STORAGE MEDIUM FOR CORRECTING MIXED COLOR

(71) Applicant: GUANGZHOU YAJIANG PHOTOELECTRIC EQUIPMENT CO., LTD., Guangdong (CN)

(72) Inventors: Zhiman Chen, Guangdong (CN); Rongfeng Huang, Guangdong (CN); Guohai Wang, Guangdong (CN)

(73) Assignee: GUANGZHOU YAJIANG PHOTOELECTRIC EQUIPMENT CO., LTD., Guangzhou (CN)

( * ) Notice: Subject to any disclaimer, the term of this patent is extended or adjusted under 35 U.S.C. 154(b) by 149 days.

(21) Appl. No.: 16/757,508

(22) PCT Filed: Jun. 25, 2019

(86) PCT No.: PCT/CN2019/092764
§ 371 (c)(1),
(2) Date: Apr. 20, 2020

(87) PCT Pub. No.: WO2020/237761
PCT Pub. Date: Dec. 3, 2020

(65) Prior Publication Data

US 2021/0410246 A1 Dec. 30, 2021

(30) Foreign Application Priority Data

May 31, 2019 (CN) ..... 201910471282.6

(51) Int. Cl.
*H05B 45/20* (2020.01)
*H05B 47/10* (2020.01)
*H05B 45/30* (2020.01)

(52) U.S. Cl.
CPC ..... *H05B 45/20* (2020.01); *H05B 45/30* (2020.01); *H05B 47/10* (2020.01)

(58) Field of Classification Search
CPC ..... H05B 45/20; H05B 45/30; H05B 47/10; H05B 47/11
See application file for complete search history.

(56) References Cited

U.S. PATENT DOCUMENTS 10,755,448 B2 * 8/2020 Chen ..... H05B 45/20
2015/0312540 A1 * 10/2015 Tuna ..... H04N 9/646 348/223.1

FOREIGN PATENT DOCUMENTS

CN 107085858 B 4/2019
CN 107101172 B 4/2019

* cited by examiner

*Primary Examiner* — Daniel D Chang

(57) ABSTRACT

The present invention discloses a method, device, terminal setting and readable storage medium for correcting mixed color. The method first acquiring color coordinates of standard mixed color and color coordinates of mixed color to be corrected, when the first difference coordinates of the two color coordinates exceed preset threshold, calculating a ratio of Y coordinate and X coordinate of the first difference coordinates to obtain first ratio, calculating coordinates difference between the first color coordinates and color coordinates of each monochromatic light to obtain difference coordinates to be processed, calculating ratios of Y coordinate and X coordinate of each difference coordinates to be processed to obtain ratios to be processed, selecting monochromatic light corresponding to a ratio to be processed with the smallest difference from the first ratio as monochromatic light to be adjusted, then realizing color correction by adjusting color channel value of the monochromatic light to be adjusted.

9 Claims, 2 Drawing Sheets acquiring color coordinates of standard mixed color as first color coordinates, and acquiring color coordinates of mixed color to be corrected as second color coordinates, wherein the mixed color to be corrected is obtained by mixing a plurality of monochromatic lights with the standard mixed color as color mixing target — S101

↓ calculating coordinates difference between the first color coordinates and the second color coordinates as first difference coordinates — S102

↓ judging whether the coordinates value of the first difference coordinates exceeds preset threshold — S103

↓ when the coordinates value of the first difference coordinates exceeds the preset threshold, calculating the ratio of Y coordinate and X coordinate of the first difference coordinates to obtain first ratio — S104

↓ calculating coordinates difference between the first color coordinates and color coordinates of each monochromatic light to obtain a plurality of difference coordinates to be processed, and calculating the ratio of Y coordinate and X coordinate of each difference coordinates to be processed respectively to obtain a plurality of ratios to be processed — S105

↓ taking a ratio to be processed with the smallest difference from the first ratio as first ratio to be processed, taking the monochromatic light corresponding to the first ratio to be processed as a monochromatic light to be adjusted which need to be adjusted, and taking the difference between the first ratio to be processed and the first ratio as first difference to be processed — S106

↓ when the first difference to be processed is zero, multiplying the X coordinate of the first difference coordinates by the X coordinate of the difference coordinates to be processed corresponding to the monochromatic light to be adjusted to obtain first product. When the first product is less than zero, reducing color channel value of the monochromatic light to be adjusted, otherwise, increasing the color channel value of the monochromatic light to be adjusted; — S107

When the first difference to be processed isn't zero, calculating the following parameters:

$$A = (y_a - y_0)/(x_a - x_0);\ B = -1;\ C = y_a - x_a \times \left((y_a - y_0)/(x_a - x_0)\right)$$

$$x_f = (B \times B \times x_1 - A \times B \times y_1 - A \times C)/(A \times A + B \times B)$$

$$y_f = (-A \times B \times x_1 + A \times A \times y_1 - B \times C)/(A \times A + B \times B)$$

$$\triangle x_f = x_f - x_0;$$

wherein $x_a$ and $y_a$ respectively are the X coordinate and Y coordinate of the color coordinates of the monochromatic light to be adjusted, $x_0$ and $y_0$ respectively are the X coordinate and Y coordinate of the color coordinates of the standard mixed color, and $x_1$ and $y_1$ respectively are the X coordinate and Y coordinate of the color coordinates of the mixed color to be corrected;

When △ less than zero, reducing the color channel value of the monochromatic light to be adjusted, otherwise, increasing the color channel value of the monochromatic light to be adjusted。

Fig. 1

METHOD, DEVICE, TERMINAL SETTING AND READABLE STORAGE MEDIUM FOR CORRECTING MIXED COLOR

FIELD OF THE INVENTION

The present invention relates to the area of lamp color control and is more particularly concerned with a method, device, terminal setting and readable storage medium for correcting mixed color.

BACKGROUND OF THE INVENTION

Respect to the currently lamp with multiple mixed color, when setting different color for it, the engineer needs to constantly try to adjust to find the correct color. The prior art, e.g. the patent with the application number of CN201710183658.4, discloses a method for rapidly realizing mixing arbitrary colors which can realize mixing arbitrary colors. However, the above color mixing method is based on the ideal condition that the color coordinate do not change under different illumination. And in fact, when the color illumination changes, the color coordinate will change slightly. Therefore, the color obtained by the above color mixing method has a deviation with the target color and the color needs to be adjusted and corrected to maintain the consistency of the color. To solve this problem, the prior art, e.g. the patent with the application number of CN201710183640.4, discloses a method for correcting mixed color. However, this method can only correct the mixed color obtained by mixing three colors, and cannot correct the mixed color obtained by mixing four or more colors.

SUMMARY OF THE INVENTION

The embodiments of the present invention provide a method, device, terminal setting and readable storage medium for correcting mixed color, which can correct the mixed color obtained by mixing any number of colors.

An embodiment of the present invention provides a method for correcting mixed color, comprising:

acquiring color coordinates of standard mixed color as first color coordinates, and acquiring color coordinates of mixed color to be corrected as second color coordinates, wherein the mixed color to be corrected is obtained by mixing a plurality of monochromatic lights with the standard mixed color as color mixing target;

calculating coordinates difference between the first color coordinates and the second color coordinates as first difference coordinates;

judging whether coordinates value of the first difference coordinates exceeds preset threshold, and when the coordinates value of the first difference coordinates exceeds preset threshold, preforming following steps;

calculating a ratio of Y coordinate and X coordinate of the first difference coordinates to obtain first ratio;

calculating coordinates difference between the first color coordinates and color coordinates of the each monochromatic light to obtain a plurality of difference coordinates to be processed, and calculating ratios of Y coordinate and X coordinate of each difference coordinates to be processed respectively to obtain a plurality of ratios to be processed;

taking a ratio to be processed with the smallest difference from the first ratio as first ratio to be processed, taking the monochromatic light corresponding to the first ratio to be processed as a monochromatic light to be adjusted which need to be adjusted, and taking the difference between the first ratio to be processed and the first ratio as first difference to be processed;

when the first difference to be processed is zero, multiplying X coordinate of the first difference coordinates by X coordinate of the difference coordinates to be processed corresponding to the monochromatic light to be adjusted to obtain first product, and when the first product is less than zero, reducing color channel value of the monochromatic light to be adjusted, otherwise, increasing the color channel value of the monochromatic light to be adjusted;

when the first difference to be processed isn't zero, calculating the following parameters, $$A=(y_a-y_0)/(x_a-x_0);\ B=-1;\ C=y_a-x_a*(y_a-y_0)/(x_a-x_0));$$

$$x_f=(B*B*x_1-A*B*y_1-A*C)/(A*A+B*B);$$

$$y_f=(-A*B*x_1+A*A*y_1-B*C)/(A*A+B*B);$$

$$\Delta x_f=x_f-x_0.$$

Wherein, $x_a$ and $y_a$ respectively are the X coordinate and Y coordinate of the color coordinates of the monochromatic light to be adjusted, $x_0$ and $y_0$ respectively are the X coordinate and Y coordinate of the color coordinates of the standard mixed color, and $x_1$ and $y_1$ respectively are the X coordinate and Y coordinate of the color coordinates of the mixed color to be corrected;

when $\Delta x_f$ less than zero, reducing the color channel value of the monochromatic light to be adjusted, otherwise, increasing the color channel value of the monochromatic light to be adjusted.

Further, the amount of color channel value change, when the monochromatic light to be adjusted is adjusted, is calculated as following:

acquiring illumination value of the mixed color to be corrected, and calculating the amount of illumination value change as following when the monochromatic light to be adjusted is adjusted, $$E_a=\frac{y_1-y_0}{\frac{y_1*y_0}{y_a}y_1}*E_1;$$

wherein, $E_a$ is the illumination value that the monochromatic light to be adjusted need to change and $E_1$ is the amount of illumination value change when the monochromatic light to be adjusted is adjusted;

according to the amount of the illumination value change, calculating the amount of color channel value change of the monochromatic light to be adjusted according to a preset linear conversion relationship.

Further, color coordinates of the each monochromatic light are obtained as following: testing each monochromatic light under full brightness illumination to obtain the color coordinates of the each monochromatic light.

Further, comprising: when coordinates value of the first difference coordinates doesn't exceed preset threshold, no processing is performed.

Based on the method embodiments, the present invention provides corresponding device embodiments.

Another embodiment of the present invention provides a device for correcting mixed color, comprising color coordinates acquisition module, first difference calculation module, and color correction module, wherein the color correction module comprises first ratio calculation unit, ratio to be processed calculation unit, first difference to be processed calculation unit and adjustment unit;

the color coordinates acquisition module is configured to acquire color coordinates of standard mixed color as first color coordinates, and acquire color coordinates of mixed color to be corrected as second color coordinates, wherein the mixed color to be corrected is obtained by mixing a plurality of monochromatic lights with the standard mixed color as color mixing target;

the first difference calculation module is configured to calculate coordinates difference between the first color coordinates and the second color coordinates as first difference coordinates;

the first ratio calculation unit is configured to calculate, when the coordinates value of the first difference coordinates exceeds preset threshold, the ratio of Y coordinate and X coordinate of the first difference coordinates to obtain first ratio;

the ratio to be processed calculation unit is configured to calculate coordinates difference between the first color coordinates and color coordinates of each monochromatic light to obtain a plurality of difference coordinates to be processed, and calculate the ratio of Y coordinate and X coordinate of each difference coordinates to be processed respectively to obtain a plurality of ratios to be processed;

the first difference to be processed calculation unit is configured to take a ratio to be processed with the smallest difference from the first ratio as first ratio to be processed, take the monochromatic light corresponding to the first ratio to be processed as a monochromatic light to be adjusted which need to be adjusted, and take the difference between the first ratio to be processed and the first ratio as first difference to be processed;

the adjustment unit is configured to multiply the X coordinate of the first difference coordinates by the X coordinate of the difference coordinates to be processed corresponding to the monochromatic light to be adjusted to obtain first product; when the first product is less than zero, reduce color channel value of the monochromatic light to be adjusted, otherwise, increase the color channel value of the monochromatic light to be adjusted;

when the first difference to be processed isn't zero, calculate the following parameters;

$$A=(y_a-y_0)/(x_a-x_0);\ B=-1;\ C=y_a-x_a*(y_a-y_0)/(x_a-x_0));$$

$$x_f=(B*B*x_1-A*B*y_1-A*C)/(A*A+B*B);$$

$$y_f=(-A*B*x_1+A*A*y_1-B*C)/(A*A+B*B);$$

$$\Delta x_f=x_f-x_0;$$

wherein $x_a$ and $y_a$ respectively are the X coordinate and Y coordinate of the color coordinates of the monochromatic light to be adjusted, $x_0$ and $y_0$ respectively are the X coordinate and Y coordinate of the color coordinates of the standard mixed color, and $x_1$ and $y_1$ respectively are the X coordinate and Y coordinate of the color coordinates of the mixed color to be corrected;

when $\Delta x_f$ less than zero, reduce the color channel value of the monochromatic light to be adjusted, otherwise, increase the color channel value of the monochromatic light to be adjusted.

Based on the method embodiments, the present invention provides another embodiment.

Another embodiment of the present invention provides a terminal apparatus for correcting mixed color, comprising processor, a memory, and a computer program stored in the memory and configured to be executed by the processor, when the processor executing the computer program, the method for correcting mixed color provided by any one of the embodiments of the present invention can be realized.

Based on the method embodiments, the present invention provides another embodiment.

Another embodiment of the present invention provides a readable storage medium, the readable storage medium comprises a stored computer program, wherein when the computer program is running, the apparatus where the readable storage medium is located is controlled to perform the method for correcting mixed color provided by any one of the embodiments of the present invention.

By implementing the embodiments of the present invention, it has the following beneficial effects.

A method, device, terminal apparatus and readable storage medium for correcting mixed color are provided by the embodiments of the present invention. The method first sets the color coordinates of the standard mixed color, and meanwhile acquires the color coordinates of the mixed color, that is the mixed color to be corrected, which is mixed by a plurality of monochromatic lights with the standard mixed color as color mixing target, then calculates the difference of the two color coordinates to obtain the first difference coordinates, judges whether the first difference coordinates exceeds preset threshold, and when the first difference coordinates exceeds preset threshold, it means that the difference between the mixed color to be corrected and the standard mixed color is large and correction is needed. At this time, first calculating the ratio of Y coordinate and X coordinate of the first difference coordinates to obtain first ratio, then calculating the difference between the color coordinates of each monochromatic light and the above first color coordinates to obtain the above difference coordinates to be processed, then calculating the ratio of Y coordinate and X coordinate of each difference coordinates to be processed to obtain the ratio to be processed, then comparing all ratios to be processed with the first ratio, and taking a monochromatic light corresponding to a ratio to be processed with the smallest difference as the monochromatic light to be adjusted, then adjusting the color channel value of the monochromatic light to realize the correction of the mixed color to be corrected. No matter the mixed color to be corrected is mixed by how many kinds of monochromatic light, what need is only select a kind of monochromatic light to be adjusted by the above method, and adjust the color channel value of the monochromatic light, then the correction of the mixed color to be corrected can be realized.

BRIEF DESCRIPTION OF DRAWINGS

FIG. 1 is a flow diagram of the method for correcting mixed color provided by an embodiment of the prevent invention.

DETAILED DESCRIPTION OF ILLUSTRATED EMBODIMENTS

Figure 2:
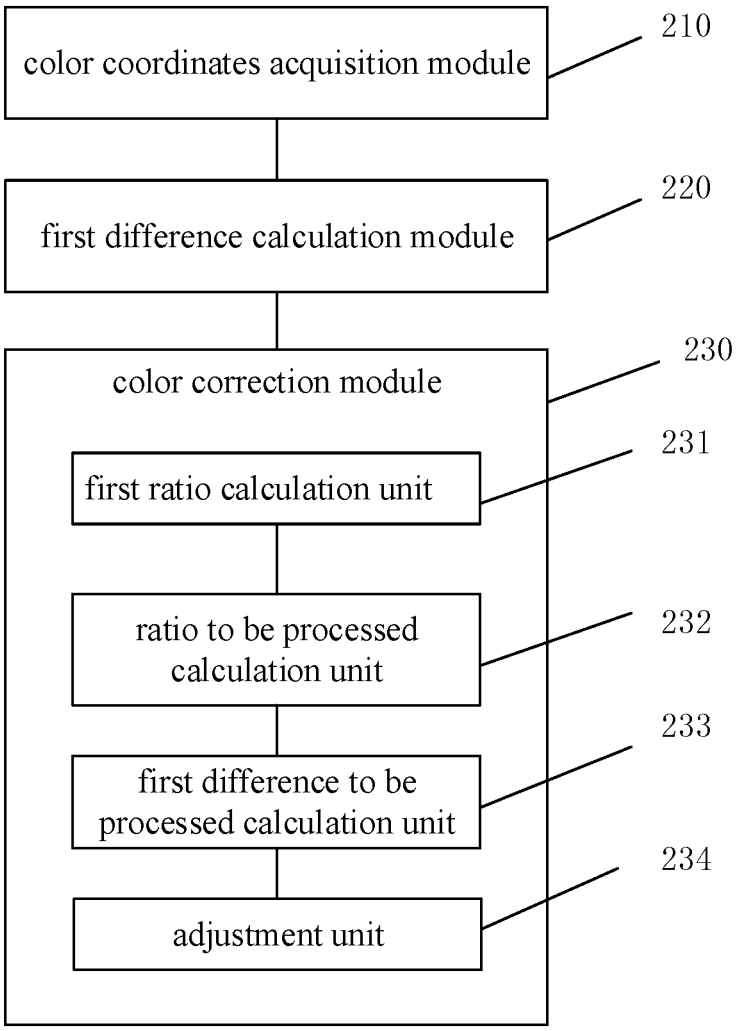
FIG. 2 is a structure diagram of the device for correcting mixed color provided by an embodiment of the prevent invention.

In the following, the technical solutions in the embodiments of the present invention will be clearly and completely described with reference to the drawings in the embodiments of the present invention. Apparently, the described embodiments are merely a part of the embodiments of the present invention, but not all embodiments.

Based on the embodiments of the present invention, all other embodiments obtained by a person of ordinary skill in the art without creative efforts shall fall within the protection scope of the present invention.

As shown in FIG. 1, the flow diagram of the method for correcting mixed color provided by an embodiment of the prevent invention, comprises:

Step S101, acquiring color coordinates of standard mixed color as first color coordinates, and acquiring color coordinates of mixed color to be corrected as second color coordinates, wherein the mixed color to be corrected is obtained by mixing a plurality of monochromatic lights with the standard mixed color as color mixing target.

Step S102, calculating coordinates difference between the first color coordinates and the second color coordinates as first difference coordinates.

Step S103, judging whether the coordinates value of the first difference coordinates exceeds preset threshold.

Step S104, when the coordinates value of the first difference coordinates exceeds the preset threshold, calculating the ratio of Y coordinate and X coordinate of the first difference coordinates to obtain first ratio.

Step S105, calculating coordinates difference between the first color coordinates and color coordinates of each monochromatic light to obtain a plurality of difference coordinates to be processed, and calculating the ratio of Y coordinate and X coordinate of each difference coordinates to be processed respectively to obtain a plurality of ratios to be processed.

Step S106, taking a ratio to be processed with the smallest difference from the first ratio as first ratio to be processed, taking the monochromatic light corresponding to the first ratio to be processed as a monochromatic light to be adjusted which need to be adjusted, and taking the difference between the first ratio to be processed and the first ratio as first difference to be processed.

Step S107, when the first difference to be processed is zero, multiplying the X coordinate of the first difference coordinates by the X coordinate of the difference coordinates to be processed corresponding to the monochromatic light to be adjusted to obtain first product. When the first product is less than zero, reducing color channel value of the monochromatic light to be adjusted, otherwise, increasing the color channel value of the monochromatic light to be adjusted.

When the first difference to be processed isn't zero, calculating the following parameters:

$$A=(y_a-y_0)/(x_a-x_0);\ B=-1;\ C=y_a-x_a*(y_a-y_0)/(x_a-x_0));$$

$$x_f=(B*B*x_1-A*B*y_1-A*C)/(A*A+B*B);$$

$$y_f=(-A*B*x_1+A*A*y_1-B*C)/(A*A+B*B);$$

$$\Delta x_f=x_f-x_0;$$

wherein $x_a$ and $y_a$ respectively are the X coordinate and Y coordinate of the color coordinates of the monochromatic light to be adjusted, $x_0$ and $y_0$ respectively are the X coordinate and Y coordinate of the color coordinates of the standard mixed color, and $x_1$ and $y_1$ respectively are the X coordinate and Y coordinate of the color coordinates of the mixed color to be corrected.

When $\Delta x_f$ less than zero, reducing the color channel value of the monochromatic light to be adjusted, otherwise, increasing the color channel value of the monochromatic light to be adjusted.

Respect to step S101, the color coordinates of the mixed color to be obtained, that is the color coordinates of the above standard mixed color, is set firstly as first color coordinates. Then acquiring the above mixed color to be corrected according to the first color coordinates with the current color mixing method, such as the method for rapidly realizing mixing arbitrary colors disclosed in patent No. 201710183658.4. For a better understanding, the following is a brief description of the above color mixing method.

The color coordinates of standard chromaticity according to 1931CIE is calculated according to tristimulus values of RGB. The formula is as follows:

$$x=\frac{X}{X+Y+Z},\quad y=\frac{Y}{X+Y+Z},\quad z=\frac{Z}{X+Y+Z}.$$

In the formula, x and y are color coordinates, X, Y and Z are tristimulus values, and Y is luminance.

Setting the color coordinates of the three primary colors to (x1, y1), (x2, y2), (x3, y3), and the target color coordinates to (x, y), and the corresponding tristimulus values thereof respectively are (X1, Y1, Z1), (X2, Y2, Z2), (X3, Y3, Z3), (X, Y, Z). According to the relationship of tristimulus values and color coordinates:

$$x1=\frac{X1}{X1+Y1+Z1} \tag{1}$$

$$y1=\frac{Y1}{X1+Y1+Z1} \tag{2}$$

$$x2=\frac{X2}{X2+Y2+Z2} \tag{3}$$

$$y2=\frac{Y2}{X2+Y2+Z2} \tag{4}$$

$$x3=\frac{X3}{X3+Y3+Z3} \tag{5}$$

$$y3=\frac{Y3}{X3+Y3+Z3}, \tag{6}$$

the color coordinates (x, y) of the mixed color is:

$$x=\frac{X1+X2+X3}{X1+X2+X3+Y1+Y2+Y3+Z1+Z2+Z3} \tag{7}$$

$$y=\frac{Y1+Y2+Y3}{X1+X2+X3+Y1+Y2+Y3+Z1+Z2+Z3}. \tag{8}$$

Setting Y1:Y2:Y3=1:Cr2:Cr3, and substituting it into the above equation to obtain Cr2 and Cr3:

$$Cr3=\frac{\left(\frac{x1-x}{Ar1}-\frac{y1-y}{Br1}\right)}{\left(\frac{Ar2}{Ar1}-\frac{Br2}{Br1}\right)} \tag{9}$$

$$Cr2=\frac{x1-x-Ar2*Cr3}{Ar1}; \tag{10}$$

-continued wherein, $$Ar1 = \frac{x*y1}{y2} - \frac{x2*y1}{y2}$$

$$Ar2 = \frac{x*y1}{y3} - \frac{x3*y1}{y3}$$

$$Br1 = \frac{y*y1}{y2} - y1$$

$$Br2 = \frac{y*y1}{y3} - y1,$$

then 1:Cr2:Cr3 is the illumination ratio of the three colors needed by the target color coordinates.

(a). When three colors RGB are mixed, to realize color mixed of target color, the illumination ratio of the three colors needs to be adjusted to 1:Cr2:Cr3.

(b). When four colors RGBW are mixed, there are two method to calculate.

Method one: Determining the illumination ratio of one color, calculating the target color (x, y) of the other three colors, then calculating the ratio of the other three colors according to the formula (9) and (10). The specific calculation process is as follows.

Setting the coordinates of the final target color O to (x0, y0), the coordinates of the fourth color W to (x4, y4), and the mixed color M mixed by the remaining three colors according to illumination of 1:Cr2:Cr3 to (x, y). According to the relation formula (1), (2), (3), (4) of tristimulus values and color coordinates and the formula of mixed color coordinates:

$$x = \frac{X1 + X2}{X1 + X2 + Y1 + Y2 + Z1 + Z2} \tag{11}$$

$$y = \frac{Y1 + Y2}{X1 + X2 + Y1 + Y2 + Z1 + Z2}, \tag{12}$$

substituting (x0, y0), (x4, y4) and the luminance ratio of the fourth color and the mixed color M mixed by the remaining three colors into the formula to obtain the coordinates of the mixed color M:

$$x = x4*B,\ y = \frac{y4}{A},$$

$$\text{wherein, } A = \frac{(1 + C)*\frac{y4}{y0} - 1}{C}$$

$$B = \frac{(1 + A*C)*\frac{x0}{x4} - 1}{A*C}.$$

Then substituting (x, y) into the formula (9) and (10) to calculate Cr2 and Cr3, and finally get the ratio of the four colors as 1:Cr2:Cr3:C*(1+Cr2+Cr3).

Method two: First determining the luminance ratio of any two colors, taking the mixed color mixed by the two colors according to the luminance ratio as one color, then mixing this mixed color and the other two colors, and calculating the mixed ratio. The specific calculation process is as follows.

Assuming that the mixed color M (x0, y0) is obtained by mixing the color B (x3, y3) and the color W (x4, y4) according to the ratio of 1:C2. Calculating the coordinates of the mixed color according to the formula (1), (2), (3), (4), (11) and (12), $$x0 = x3*\frac{1 + B2*C2*A2}{1 + A2*C2} \tag{13}$$

$$y0 = y3*\frac{1 + C2}{1 + A2*C2}$$

wherein, (14)

$$A2 = \frac{y3}{y4},\ B2 = \frac{x4}{x3},\ C2 = \frac{E4}{E3}.$$

Then substituting M (x0, y0) into the formula (9) and (10) to calculate Cr2 and Cr3, and finally get the ratio of the four colors as $$1 : Cr2 : \frac{Cr3}{1 + C2} : C2*Cr3(1 + C2).$$

(c). When five color RGBWA are mixed, the luminance ratio of three colors can be determined first, and the mixed color mixed by the three colors according to the luminance ratio can be seen as one color. Then mixing this mixed color and the other two colors and calculating the mixed ratio. The specific calculation process is as follows.

Assuming that the mixed color M (x0, y0) is obtained by mixing the color B (x3, y3), color W (x4, y4) and color A (x5, y5) according to the ratio 1:C3:C4, then calculating the coordinates of the mixed color M according to the formula (1)-(8), $$x0 = x3*\frac{1 + B3*C3*A3 + B4*C4*A4}{1 + A4*C4 + A3*C3}$$

$$y0 = y3*\frac{1 + C4 + C3}{1 + A4*C4 + A3*C3},$$

wherein, $$A3 = \frac{y3}{y4},\ A4 = \frac{y3}{y5},\ B3 = \frac{x4}{x3},\ B4 = \frac{x5}{x3},\ C3 = \frac{E4}{E3},\ C4 = \frac{E5}{E3}.$$

Then substituting M (x0, y0) into the formula (9) and (10) to calculate Cr2 and Cr3, and finally get the ratio of the four colors as $$1 : Cr2 : \frac{1}{Cr3} : \frac{C3}{Cr3} : \frac{C4}{Cr3}.$$

For the mixing of more than five colors, it is only need to first determine the ratio of colors other than two colors, taking it as one color, and then mixing it with the remaining two colors.

According to the above color mixing method, under the condition that the color coordinates of the standard mixed color are known, when the standard mixed color is used as the color mixing target, the illumination value of each monochromatic light when color mixing can be calculated. The above mixed color to be corrected of the present invention can be obtained by mixing colors according to the illumination value of each monochromatic light, then the above second color coordinates can be obtained by directly calculating the color coordinates of the mixed color to be corrected.

The remaining steps of the solution are illustrated as follows. In order to avoid confusion with the meaning of the letters mentioned in step S101, the meaning of the letters involved in steps S102 to S107 is redefined here.

The first color coordinates are $(x_0, y_0)$, the second color coordinates are $(x_1, y_1)$ and the color coordinates of the four monochromatic lights R, Q B and W, under full brightness illumination, are measured respectively as $(x_r, y_r)$, $(x_g, y_g)$, $(x_b, y_b)$ and $(x_w, y_w)$. The definition of each letter in the subsequent steps S102 to S107 is subject to this, and has nothing to do with the definition of the letters mentioned in step S101.

Respect to the step S102, when the first color coordinates are $(x_0, y_0)$ and the second color coordinates are $(x_1, y_1)$, the first difference coordinates are $(\Delta x_1, \Delta y_1)$, wherein, $\Delta x_1 = x_1 - x_0$ and $\Delta_{y1} = y_1 - y_0$.

Then the color correction steps of the subsequent steps S104 to S105 are performed.

Respect to the step S103, specifically, when $|\Delta x1| < 0.002$ and $\Delta y1 < 0.002$, the above mixed color to be corrected meets the requirement and no correction is required. At this time, in a preferred embodiment, no processing is required. Otherwise, it's determined that the above first difference coordinates exceed the preset threshold. At this time, it is explained that the difference between the mixed color to be corrected and the standard mixed color is large, and adjustment is needed. Then the color correction steps of the subsequent steps S104 to S105 are performed.

Respect to the step S104, specifically, when the first difference coordinates are $(\Delta x_1, \Delta y_1)$, the first ratio is $k_1 = \Delta y_1 / \Delta x_1$.

Respect to the step S105, specifically, assuming that the above mixed color to be corrected is mixed by four monochromatic lights, and in a preferred embodiment, testing each monochromatic light under full brightness illumination to obtain the color coordinates of each monochromatic light. For example, respect to the four monochromatic lights R, C; B and W, under full brightness illumination, their color coordinates respectively are $(x_r, y_r)$, $(x_g, y_g)$, $(x_b, y_b)$ and $(x_w, y_w)$. Then the above several difference coordinates to be processed are $(\Delta x_r, \Delta y_r)$, $(\Delta x_g, \Delta y_g)$, $(\Delta x_b, \Delta y_b)$, $(\Delta x_w, \Delta y_w)$, wherein, $\Delta x_r = x_r - x_0$, $\Delta y_r = y_r - y_0$, $\Delta x_g = x_g - x_0$, $\Delta y_g = y_g - y_0$, $\Delta x_b = x_b - x_0$, $\Delta y_b = y_b - y_0$, $\Delta x_w = y_w - x_0$ and $\Delta y_w = y_w - y_0$. And the above several ratio to be processed respectively are $k_r = \Delta y_r / \Delta x_r$, $k_g = \alpha y_g / \Delta x_g$, $k_b = \Delta y_b / \Delta x_b$, and $k_w = \Delta y_w / \Delta x_w$.

Respect to step 106, still taking the above four monochromatic lights as an example, calculating the absolute value of the difference between the ratio to be processed corresponding to each monochromatic light and the above first ratio, and when the absolute value is the smallest, the difference is the smallest. Taking the ratio to be processed with the smallest difference from the first ratio as the first ratio to be processed. Specifically, calculating and comparing $|k_1 - k_r|$, $|k_1 - k_g|$, $|k_1 - k_b|$, and $|k_1 - k_w|$, when $|k_1 - k_r|$ is the smallest, the above first ratio to be processed is $k_r$. Since the monochromatic light corresponding to $k_r$ is R, the monochromatic light R is took as the above monochromatic light to be corrected, and the above first difference is $|k_1 - k_r|$.

Respect to step 107, specifically, when the first difference to be processed is zero, that is $|k_1 - k_r| = 0$, multiplying the X coordinate $\Delta x_1$ of the first difference coordinates by the X coordinate $\Delta x_r$ of the difference coordinates to be processed corresponding to the monochromatic light to be adjusted, that is $\Delta x_1 * \Delta x_r$. When $\Delta x_1 * \Delta x_r < 0$, reducing color channel value of the monochromatic light to be adjusted (the monochromatic light R), and when $\Delta x_1 * \Delta x_r \geq 0$, increasing color channel value of the monochromatic light to be adjusted (the monochromatic light R).

When the first difference to be processed isn't zero, that is $|k_1 - k_r| \neq 0$, calculating the following parameters:

$$A = (y_r - y_0)/(x_r - x_0);\ B = -1;\ C = y_r - x_r * (y_r - y_0)/(x_r - x_0));$$

$$x_f = (B*B*x_1 - A*B*y_1 - A*C)/(A*A + B*B);$$

$$y_f = (-A*B*x_1 + A*A*y_1 - B*C)/(A*A + B*B);$$

$$\Delta x_f = x_f - x_0.$$

When $\Delta x_f < 0$, reducing color channel value of the monochromatic light R, and when $\Delta x_f \geq 0$, increasing color channel value of the monochromatic light R.

Then the correction of the mixed color to be corrected can be realized.

In a preferred embodiment, after realizing the correction of the mixed color to be corrected, the corrected mixed color can be used as a new mixed color to be corrected, and the steps S102 to S103 can be repeatedly performed until the correction is completed.

In a preferred embodiment, the amount of color channel value change, when the monochromatic light to be adjusted is adjusted, is calculated by the following method.

Acquiring the illumination value of the mixed color to be corrected, and calculating the amount of illumination value change, when the monochromatic light to be adjusted is adjusted, according to the following method:

$$E_a = \frac{y_1 - y_0}{\frac{y_1 * y_0}{y_a} y_1} * E_1.$$

Wherein, $E_a$ is the illumination value that the monochromatic light to be adjusted need to change and $E_1$ is the amount of illumination value change when the monochromatic light to be adjusted is adjusted.

According to the amount of the illumination value change, calculating the amount of color channel value change of the monochromatic light to be adjusted according to a preset linear conversion relationship.

It should be noted that, in the art, the conversion relationship between the illumination value and the channel value can be set according to the actual situation. It can be obtained by linear conversion, which is well known in the art and will not be developed here.

Based on the above method embodiments, the corresponding device embodiments are provided.

As shown in FIG. 2, a device for correcting mixed color is provided by a embodiment of the present invention. The device comprises color coordinates acquisition module 210, first difference calculation module 220 and color correction module 230. wherein, the color correction module 230 comprises first ratio calculation unit 231, ratio to be processed calculation unit 232, first difference to be processed calculation unit 233 and adjustment unit 234.

The color coordinates acquisition module 210 is configured to acquire color coordinates of standard mixed color as first color coordinates, and acquire color coordinates of mixed color to be corrected as second color coordinates, wherein the mixed color to be corrected is obtained by mixing a plurality of monochromatic lights with the standard mixed color as color mixing target.

The first difference calculation module 220 is configured to calculate coordinates difference between the first color coordinates and the second color coordinates as first difference coordinates.

The first ratio calculation unit 231 is configured to calculate, when the coordinates value of the first difference coordinates exceeds preset threshold, the ratio of Y coordinate and X coordinate of the first difference coordinates to obtain first ratio.

The ratio to be processed calculation unit 232 is configured to calculate coordinates difference between the first color coordinates and color coordinates of each monochromatic light to obtain a plurality of difference coordinates to be processed, and calculate the ratio of Y coordinate and X coordinate of each difference coordinates to be processed respectively to obtain a plurality of ratios to be processed.

The first difference to be processed calculation unit 233 is configured to take a ratio to be processed with the smallest difference from the first ratio as first ratio to be processed, take the monochromatic light corresponding to the first ratio to be processed as a monochromatic light to be adjusted which need to be adjusted, and take the difference between the first ratio to be processed and the first ratio as first difference to be processed.

The adjustment unit 234 is configured to multiply the X coordinate of the first difference coordinates by the X coordinate of the difference coordinates to be processed corresponding to the monochromatic light to be adjusted to obtain first product; when the first product is less than zero, reduce color channel value of the monochromatic light to be adjusted, otherwise, increase the color channel value of the monochromatic light to be adjusted; when the first difference to be processed isn't zero, calculate the following parameters:

$$A=(y_a-y_0)/(x_a-x_0);\ B=-1;\ C=y_a-x_a*(y_a-y_0)/(x_a-x_0));$$

$$x_f=(B*B*x_1-A*B*y_1-A*C)/(A*A+B*B);$$

$$y_f=(-A*B*x_1+A*A*y_1-B*C)/(A*A+B*B);$$

$$\Delta x_f=x_f-x_0;$$

wherein $x_a$ and $y_a$ respectively are the X coordinate and Y coordinate of the color coordinates of the monochromatic light to be adjusted, $x_0$ and $y_0$ respectively are the X coordinate and Y coordinate of the color coordinates of the standard mixed color, and $x_1$ and $y_1$ respectively are the X coordinate and Y coordinate of the color coordinates of the mixed color to be corrected;

when $\Delta x_f$ less than zero, reduce the color channel value of the monochromatic light to be adjusted, otherwise, increase the color channel value of the monochromatic light to be adjusted.

It can be understood that the above device embodiments correspond to the method embodiments of the present invention, which can realize the method for correcting mixed color provided by any one of the above method embodiments of the present invention.

It should be noted that the device embodiments described above are only example, wherein the unit/module described as separate components may or may not be separated in physically, and the components displayed as unit/module may or may not be physical unit/module, that is, it may be located in one place, or may be distributed on multiple network units. Some or all of the modules may be selected according to actual needs to achieve the objective of the solution of the embodiments. In addition, in the drawings of the device embodiments provided by the present invention, the connection relationship between the modules indicates that there is a communication connection between them, which may be specifically implemented as one or more communication buses or signal lines. The ordinary person skilled in the art can understand and implement without creative efforts. The schematic diagram is only an example of a device for correcting mixed color, and does not constitute a limitation on the device for correcting mixed color. It may include more or fewer components than the illustration, or combine some components, or different components.

Based on the method embodiments, a corresponding embodiment is provided.

Another embodiment of the present invention provides a terminal apparatus for correcting mixed color. The terminal apparatus comprises a processor, a memory, and a computer program stored in the memory and configured to be executed by the processor. When the processor executing the computer program, the method for correcting mixed color provided by any one of the above method embodiments of the present invention can be realized.

Exemplary, the computer program may be divided into one or more module/unit, and the one or more module/unit are stored in the memory and executed by the processor to complete the present invention. The one or more module/unit may be a series of computer program instruction segments with a capable of performing specific functions, and the instruction segments are configured to describe the execution process of the computer program in the terminal apparatus.

The terminal apparatus may be a computing apparatus such as a desktop computer, a notebook, a palmtop computer, a cloud server and so on. The terminal apparatus may include, but is not limited to, a processor and a memory. Those skilled in the art may understand that, for example, the terminal apparatus may further comprise an input and output device, a network access device, a bus, and the like.

The processor may be a Central Processing Unit (CPU), or other general-purpose processors, Digital Signal Processor (DSP), Application Specific Integrated Circuit (ASIC), Field-Programmable Gate Array (FPGA) or other programmable logic devices, discrete gate or transistor logic devices, discrete hardware components, etc. The general-purpose processor may be a microprocessor or the processor may be any conventional processor, etc. The processor is the control center of the terminal apparatus, and connects various parts of the entire terminal apparatus with various interfaces and lines.

The memory may be configured to store the computer program and/or module, and the processor runs or executes the computer program and/or module stored in the memory and calls the data stored in the memory to realize the various functions of the apparatus. The memory may mainly include a storage program area and a storage data area, wherein the storage program area may store an operating system, application programs required by at least one function (such as sound playback function, image playback function, etc.), etc., and the storage data area may store data created according to the use of mobile phones (such as audio data, phonebooks, etc.), etc. In addition, the memory may include high-speed random access memory, and may also include non-volatile memory, such as hard disk, memory, plug-in hard disk, Smart Media Card (SMC), Secure Digital (SD) card, Flash card, at least one disk storage component, flash memory component, or other volatile solid-state storage components.

Based on the above method embodiments, another corresponding embodiment is provided.

Another embodiment of the present invention provides a readable storage medium, the readable storage medium comprises a stored computer program, wherein, when the computer program is running, the apparatus where the readable storage medium is located is controlled to perform the method for correcting mixed color provided by any method embodiment method.

Wherein, the above readable storage medium is a computer-readable storage medium, and it can be understood that when the module/unit integrated in the device terminal apparatus for correcting mixed color is implemented in the form of software functional unit and sold or used as an independent product, it can be stored in a computer readable storage medium. Based on this understanding, the present invention can implement all or part of the processes in the methods of the above embodiments by instructing relevant hardware instructed by a computer program. The computer program can be stored in a computer-readable storage medium. When the computer program is executed by processor, the steps of the foregoing method embodiments can be implemented. Wherein, the computer program includes computer program code, and the computer program code may be in a form of source code, a form of object code, an executable file, or some form of intermediate, etc.

The computer readable medium may include: any entity or device, recording medium, USB flash disk, mobile hard disk, magnetic disk, optical disk, computer memory, Read-Only Memory (ROM), Random Access Memory (RAM), electrical carrier signals, telecommunications signals and software distribution media, etc. capable of carrying the computer program code.

By implementing the embodiments of the present invention, it has the following beneficial effects.

A method, device, terminal apparatus and readable storage medium for correcting mixed color are provided by the embodiments of the present invention. The method first sets the color coordinates of the standard mixed color, and meanwhile acquires the color coordinates of the mixed color, that is the mixed color to be corrected, which is mixed by a plurality of monochromatic lights with the standard mixed color as color mixing target, then calculates the difference of the two color coordinates to obtain the first difference coordinates, judges whether the first difference coordinates exceeds preset threshold, and when the first difference coordinates exceeds preset threshold, it means that the difference between the mixed color to be corrected and the standard mixed color is large and correction is needed. At this time, first calculating the ratio of Y coordinate and X coordinate of the first difference coordinates to obtain first ratio, then calculating the difference between the color coordinates of each monochromatic light and the above first color coordinates to obtain the above difference coordinates to be processed, then calculating the ratio of Y coordinate and X coordinate of each difference coordinates to be processed to obtain the ratio to be processed, then comparing all ratios to be processed with the first ratio, and taking a monochromatic light corresponding to a ratio to be processed with the smallest difference as the monochromatic light to be adjusted, then adjusting the color channel value of the monochromatic light to realize the correction of the mixed color to be corrected. No matter the mixed color to be corrected is mixed by how many kinds of monochromatic light, what need is only select a kind of monochromatic light to be adjusted by the above method, and adjust the color channel value of the monochromatic light, then the correction of the mixed color to be corrected can be realized.

The above-mentioned embodiments are the preferred embodiments of the present invention. Variations and modifications are allowed within the scope of the invention. Those skilled in the art will appreciate that the features described above can be combined in various ways to form multiple variations of the invention. As a result, such variations fall within the scope of the protection to the present invention.

What is claimed is:

1. A device for correcting mixed color, wherein the device comprises:

a color coordinates acquisition module, a first difference calculation module, and a color correction module, wherein the color correction module comprises a first ratio calculation unit, a ratio to be processed calculation unit, a first difference to be processed calculation unit and an adjustment unit;

the color coordinates acquisition module is configured to acquire color coordinates of standard mixed color as first color coordinates, and acquire color coordinates of mixed color to be corrected as second color coordinates, wherein the mixed color to be corrected is obtained by mixing a plurality of monochromatic lights with the standard mixed color as a color mixing target;

the first difference calculation module is configured to calculate a coordinates difference between the first color coordinates and the second color coordinates as first difference coordinates;

the first ratio calculation unit is configured to calculate, when a coordinates value of the first difference coordinates exceeds a preset threshold, a ratio of the Y coordinate and the X coordinate of the first difference coordinates to obtain a first ratio;

the ratio to be processed calculation unit is configured to calculate coordinates difference between the first color coordinates and color coordinates of each monochromatic light to obtain a plurality of difference coordinates to be processed, and calculate a ratio of a Y coordinate and a X coordinate of each and every one of the plurality of difference coordinates to be processed respectively to obtain a plurality of ratios to be processed;

the first difference to be processed calculation unit is configured to take one of the plurality of ratios to be processed with the smallest difference from the first ratio as a first ratio to be processed, take the monochromatic light corresponding to the first ratio to be processed as a monochromatic light to be adjusted which need to be adjusted, and take the difference between the first ratio to be processed and the first ratio as a first difference to be processed;

the adjustment unit is configured to multiply the X coordinate of the first difference coordinates by the X coordinate of the difference coordinates to be processed corresponding to the monochromatic light to be adjusted to obtain a first product; when the first product is less than zero, reduce a color channel value of the monochromatic light to be adjusted, otherwise, increase the color channel value of the monochromatic light to be adjusted;

when the first difference to be processed isn't zero, calculate the following parameters;

$$A=(y_a-y_0)/(x_a-x_0);\ B=-1;\ C=y_a-x_a*(y_a-y_0)/(x_a-x_0));$$

$$x_f=(B*B*x_1-A*B*y_1-A*C)/(A*A+B*B);$$

$$y_f=(-A*B*x_1+A*A*y_1-B*C)/(A*A+B*B);$$

$$\Delta x_f=x_f-x_0.$$

wherein $x_a$ and $y_a$ respectively are the X coordinate and Y coordinate of the color coordinates of the monochromatic light to be adjusted, $x_0$ and $y_0$ respectively are the X coordinate and Y coordinate of the color coordinates of the standard mixed color, and $x_1$ and $y_1$ respectively are the X coordinate and Y coordinate of the color coordinates of the mixed color to be corrected;

when $\Delta x_f$ is less than zero, reduce the color channel value of the monochromatic light to be adjusted, otherwise, increase the color channel value of the monochromatic light to be adjusted.

2. A terminal apparatus for correcting mixed color, comprising a processor, a memory, and a computer program stored in the memory and configured to be executed by the processor, when the processor executing the computer program, a method for correcting mixed color can be realized;

wherein the method for correcting mixed color comprises:

acquiring color coordinates of standard mixed color as first color coordinates, and acquiring color coordinates of mixed color to be corrected as second color coordinates, wherein the mixed color to be corrected is obtained by mixing a plurality of monochromatic lights with the standard mixed color as a color mixing target;

calculating a coordinates difference between the first color coordinates and the second color coordinates as first difference coordinates;

judging whether coordinates value of the first difference coordinates exceeds preset threshold, and when the coordinates value of the first difference coordinates exceeds preset threshold, preforming following steps;

calculating a ratio of the Y coordinate and X coordinate of the first difference coordinates to obtain a first ratio;

calculating coordinate differences between the first color coordinates and color coordinates of each monochromatic light to obtain a plurality of difference coordinates to be processed, and calculating a ratio of the Y coordinate and X coordinate of each and every one of the plurality of difference coordinates to be processed respectively to obtain a plurality of ratios to be processed;

taking one of the plurality of ratios to be processed with the smallest difference from the first ratio as a first ratio to be processed, taking the monochromatic light corresponding to the first ratio to be processed as a monochromatic light to be adjusted which needs to be adjusted, and taking the difference between the first ratio to be processed and the first ratio as a first difference to be processed;

when the first difference to be processed is zero, multiplying the X coordinate of the first difference coordinates by the X coordinate of the difference coordinates to be processed corresponding to the monochromatic light to be adjusted to obtain a first product, and when the first product is less than zero, reducing color channel value of the monochromatic light to be adjusted, otherwise, increasing the color channel value of the monochromatic light to be adjusted;

when the first difference to be processed isn't zero, calculating the following parameters, $$A=(y_a-y_0)/(x_a-x_0);\ B=-1;\ C=y_a-x_a*(y_a-y_0)/(x_a-x_0));$$

$$x_f=(B*B*x_1-A*B*y_1-A*C)/(A*A+B*B);$$

$$y_f=(-A*B*x_1+A*A*y_1-B*C)/(A*A+B*B);$$

$$\Delta x_f=x_f-x_0;$$

wherein, $x_a$ and $y_a$ respectively are the X coordinate and Y coordinate of the color coordinates of the monochromatic light to be adjusted, $x_0$ and $y_0$ respectively are the X coordinate and Y coordinate of the color coordinates of the standard mixed color, and $x_1$ and $y_1$ respectively are the X coordinate and Y coordinate of the color coordinates of the mixed color to be corrected;

when $\Delta x_f$ is less than zero, reducing the color channel value of the monochromatic light to be adjusted, otherwise, increasing the color channel value of the monochromatic light to be adjusted.

3. The terminal apparatus for correcting mixed color according to claim 2, comprising a processor, a memory, and a computer program stored in the memory and configured to be executed by the processor, when the processor executing the computer program, a method for correcting mixed color can be realized;

wherein an amount of color channel value change, when the monochromatic light to be adjusted is adjusted, is calculated as follows:

acquiring an illumination value of the mixed color to be corrected, and calculating an amount of illumination value change as follows when the monochromatic light to be adjusted is adjusted, $$E_a=\frac{y_1-y_0}{\frac{y_1*y_0}{y_a}y_1}*E_1;$$

wherein, $E_a$ is the illumination value that the monochromatic light to be adjusted need to change and $E_1$ is the amount of illumination value change when the monochromatic light to be adjusted is adjusted;

according to the amount of the illumination value change, calculating the amount of color channel value change of the monochromatic light to be adjusted according to a preset linear conversion relationship.

4. The terminal apparatus for correcting mixed color according to claim 2, comprising a processor, a memory, and a computer program stored in the memory and configured to be executed by the processor, when the processor executing the computer program, a method for correcting mixed color can be realized;

wherein color coordinates of each monochromatic light are obtained as follows:

testing each monochromatic light under full brightness illumination to obtain the color coordinates of the each monochromatic light.

5. The terminal apparatus for correcting mixed color according to claim 2, comprising a processor, a memory, and a computer program stored in the memory and configured to be executed by the processor, when the processor executing the computer program, a method for correcting mixed color can be realized;

wherein the method further comprises:

when the coordinates value of the first difference coordinates doesn't exceed the preset threshold, no processing is performed.

6. A non-transitory readable storage medium, wherein the non-transitory readable storage medium comprises a stored computer program, wherein when the computer program is running, an apparatus where the non-transitory readable storage medium is located is controlled to perform a method for correcting mixed color;

wherein the method for correcting mixed color comprises:

acquiring color coordinates of standard mixed color as first color coordinates, and acquiring color coordinates of mixed color to be corrected as second color coordinates, wherein the mixed color to be corrected is obtained by mixing a plurality of monochromatic lights with the standard mixed color as a color mixing target;

calculating a coordinates difference between the first color coordinates and the second color coordinates as first difference coordinates;

judging whether coordinates value of the first difference coordinates exceeds preset threshold, and when the coordinates value of the first difference coordinates exceeds preset threshold, preforming following steps;

calculating a ratio of the Y coordinate and X coordinate of the first difference coordinates to obtain a first ratio;

calculating coordinate differences between the first color coordinates and color coordinates of each monochromatic light to obtain a plurality of difference coordinates to be processed, and calculating a ratio of the Y coordinate and X coordinate of each and every one of the plurality of difference coordinates to be processed respectively to obtain a plurality of ratios to be processed;

taking one of the plurality of ratios to be processed with the smallest difference from the first ratio as a first ratio to be processed, taking the monochromatic light corresponding to the first ratio to be processed as a monochromatic light to be adjusted which needs to be adjusted, and taking the difference between the first ratio to be processed and the first ratio as a first difference to be processed;

when the first difference to be processed is zero, multiplying the X coordinate of the first difference coordinates by the X coordinate of the difference coordinates to be processed corresponding to the monochromatic light to be adjusted to obtain a first product, and when the first product is less than zero, reducing color channel value of the monochromatic light to be adjusted, otherwise, increasing the color channel value of the monochromatic light to be adjusted;

when the first difference to be processed isn't zero. calculating the following parameters, $$A=(y_a-y_0)/(x_a-x_0);\ B=-1;\ C=y_a-x_a*(y_a-y_0)/(x_a-x_0));$$

$$x_f=(B*B*x_1-A*B*y_1-A*C)/(A*A+B*B);$$

$$y_f=(-A*B*x_1+A*A*y_1-B*C)/(A*A+B*B);$$

$$\Delta x_f=x_f-x_0;$$

wherein, $x_a$ and $y_a$ respectively are the X coordinate and Y coordinate of the color coordinates of the monochromatic light to be adjusted, $x_0$ and $y_0$ respectively are the X coordinate and Y coordinate of the color coordinates of the standard mixed color, and $x_1$ and $y_1$ respectively are the X coordinate and Y coordinate of the color coordinates of the mixed color to be corrected;

when $\Delta x_f$ is less than zero, reducing the color channel value of the monochromatic light to be adjusted, otherwise, increasing the color channel value of the monochromatic light to be adjusted.

7. The non-transitory readable storage medium according to claim 6, wherein the non-transitory readable storage medium comprises a stored computer program, wherein when the computer program is running, an apparatus where the non-transitory readable storage medium is located is controlled to perform a method for correcting mixed color;

wherein an amount of color channel value change, when the monochromatic light to be adjusted is adjusted, is calculated as follows:

acquiring an illumination value of the mixed color to be corrected, and calculating an amount of illumination value change as follows when the monochromatic light to be adjusted is adjusted, $$E_a=\frac{y_1-y_0}{\frac{y_1*y_0}{y_a}y_1}*E_1;$$

wherein, $E_a$ is the illumination value that the monochromatic light to be adjusted need to change and $E_1$ is the amount of illumination value change when the monochromatic light to be adjusted is adjusted;

according to the amount of the illumination value change, calculating the amount of color channel value change: of the monochromatic light to be adjusted according to a preset linear conversion relationship.

8. The non-transitory readable storage medium according to claim 6, wherein the non-transitory readable storage medium comprises a stored computer program, wherein when the computer program is running, an apparatus where the non-transitory readable storage medium is located is controlled to perform a method for correcting mixed color;

wherein color coordinates of each monochromatic light are obtained as follows:

testing each monochromatic light under full brightness illumination to obtain the color coordinates of the each monochromatic light.

9. The non-transitory readable storage medium according to claim 6, wherein the non-transitory readable storage medium comprises a stored computer program, wherein when the computer program is running, an apparatus where the non-transitory readable storage medium is located is controlled to perform a method for correcting mixed color;

wherein the method further comprises:

when the coordinates value of the first difference coordinates doesn't exceed the preset threshold, no processing is performed.

* * * * *